United States Patent [19]

Steinkuhl et al.

[11] 4,199,194

[45] Apr. 22, 1980

[54] CONTROL MEANS FOR A COAL PLOUGH

[75] Inventors: Bernd Steinkuhl, Lunen; Oswald Breuer, Dortmund-Husen, both of Fed. Rep. of Germany

[73] Assignee: Gewerkschaft Eisenhutte Westfalia, Lunen, Fed. Rep. of Germany

[21] Appl. No.: 9,716

[22] Filed: Feb. 5, 1979

[30] Foreign Application Priority Data

Feb. 6, 1978 [DE] Fed. Rep. of Germany ..... 2804976

[51] Int. Cl.[2] ..... E21C 27/44

[52] U.S. Cl. ..... 299/34; 299/80

[58] Field of Search ..... 299/32, 34, 80

[56] References Cited

U.S. PATENT DOCUMENTS

| | | | |
|---|---|---|---|
| 3,877,752 | 4/1975 | Hauschopp et al. | 299/34 |
| 4,025,117 | 5/1977 | Bahre et al. | 299/34 |
| 4,141,593 | 2/1979 | Braun et al. | 299/34 |

FOREIGN PATENT DOCUMENTS

| | | | |
|---|---|---|---|
| 1211569 | 3/1966 | Fed. Rep. of Germany | 299/34 |

*Primary Examiner*—Ernest R. Purser
*Attorney, Agent, or Firm*—Neil F. Markva

[57] ABSTRACT

A coal plough which is movable to and fro in a mine working alongside a coal face, has floor-level cutters mounted on a carrier. The carrier is pivotable in a vertical plane about a horizontal axis perpendicular to the coal face. The carrier is pivotable between a working position, in which it bears against a first stop, and a non-working position, in which it bears against a second stop. The cutters bear against the floor of the working when the carrier is in the working position and are lifted clear of the floor when the carrier is in the non-working position. The first stop defines the level of cut of the cutters, and the second stop limits the upward pivotal movement of the carrier. The first and second stops are provided on the plough. The carrier is provided with cutter control means constituted by a peg which extends from the carrier towards the floor, the peg engaging the floor to move the carrier into the working position when the plough moves in one direction and to move the carrier into the non-working position when the plough moves in the opposite direction.

11 Claims, 3 Drawing Figures

CONTROL MEANS FOR A COAL PLOUGH

BACKGROUND TO THE INVENTION

This invention relates to means for controlling the floor-level cutters of a coal plough.

DT-OS 2,250,535 describes a coal plough having two sets of floor-level cutters mounted on respective carriers at the two ends of the plough, one set of cutters being operative for each direction of plough travel. Each carrier can be pivoted between a working position, in which its cutters are operative, and a non-working position, in which its cutters are not operative. Thus, the floor-level cutters which are not operative, in each direction of plough travel, can be pivoted upwardly out of contact with the floor of the mine working so as to reduce the rate at which they wear. The distance through which each carrier can pivot towards the floor is limited by means of an adjustable stop constituted by a pin which is insertable into any one of a plurality of holes formed in the plough body. Pivoting in the other (upward) direction is limited by a fixed stop provided on the plough body. The disadvantage of this type of plough is that, when the direction of plough travel is changed, the floor level cutters previously inoperative cannot be guaranteed to pivot into their working positions, and the cutters previously operative cannot be guaranteed to pivot into their working positions.

DT-AS 2,340,302 discloses a coal plough whose main cutters are pivoted into, and out of, working positions by control means engageable with the coal face. Unfortunately, this type of control means is not suitable for controlling floor-level cutters.

SUMMARY OF THE INVENTION

The present invention provides, in a coal plough which is movable to and fro in a mine working alongside a coal face, the plough having floor-level cutters mounted on a carrier which is pivotable in a vertical plane about a horizontal axis perpendicular to the coal face between a working position, in which it bears against a first stop, and a non-working position, in which it bears against a second stop, the cutters bearing against the floor of the working when the carrier is in the working position and being lifted clear of the floor when the carrier is in the non-working position, the first stop defining the level of cut of the cutters and the second stop limiting the upward pivotal movement of the carrier, and the first and second stops being provided on the plough, the improvement comprising cutter control means constituted by a peg which extends from the carrier towards the floor, the peg engaging the floor to move the carrier into the working position when the plough moves in one direction and to move the carrier into the non-working position when the plough moves in the opposite direction.

Thus, the floor-level cutters are swung into, or out of, their operative positions each time the direction of plough travel is reversed. Moreover, the engagement of the peg with the floor of the working ensures that operative cutters are held in their working positions (and inoperative cutters are held out of their working positions) until the next reversal of plough movement.

Preferably, the peg extends radially away from the axis about which the carrier pivots.

Advantageously, the peg is provided with a stop member which co-operates with the second stop to limit the upward pivotal movement of the carrier. Preferably, the stop member forms part of the peg. In this way, it is possible to dispense with a stop provided specifically for this purpose.

The peg may be made of wear-resistant material. Alternatively, the peg is provided with a floor-engaging tip made of wear-resistant material. In either case, the rate of peg wear is reduced which results in extended peg life.

Advantageously, the peg is adjustably mounted on the carrier. Preferably, the peg is adjustably mounted on the carrier for movement in a radial direction with respect to said pivotal axis. This adjustability of the peg enables the resistance offered by the floor to the movement of the peg to be varied to adapt the control means to the properties of the coal being won. This is achieved by increasing or decreasing the depth of penetration of the peg into the floor.

Preferably, the peg is provided with a plurality of longitudinally-spaced grooves, and the carrier is provided with a locking member which engages within a given one of said grooves to lock the peg at a predetermined radially adjusted position. This enables the peg to be locked in any one of a plurality of positions in a simple yet reliable manner.

The invention also provides a coal plough which is movable to and fro in a mine working alongside a coal face, the plough having two sets of floor-level cutters, one set of floor cutters being provided at one end of the plough and being operative to win coal when the plough moves in one direction, and the other set of floor-cutters being provided at the other end of the plough and being operative to win coal when the plough moves in the other direction, each set of floor-cutters being mounted on a respective carrier which is pivotable in a vertical plane about a horizontal axis perpendicular to the coal face between a working position, in which it bears against a first stop, and a non-working position, in which it bears against a second stop, the cutters of each set bearing against the floor of the working when the carrier of that set is in the working position and being lifted clear of the floor when said carrier is in the non-working position, the first stops defining the level of cut of the cutters and the second stops limiting the upward pivotal movement of the carriers, and the first and second stops being provided on the plough, wherein each carrier is provided with a peg which extends therefrom towards the floor, the peg associated with said one set of floor-level cutters engaging the floor to move the carrier of that set into the working position when the plough moves in said one direction and to move that carrier into the non-working position when the plough moves in said other direction, and the peg associated with said other set of floor-level cutters engaging the floor to move the carrier of that set into the working position when the plough moves in said other direction and to move that carrier into the non-working position when the plough moves in said one direction.

BRIEF DESCRIPTION OF THE DRAWINGS

A coal plough provided with control means constructed in accordance with the invention will now be described, by way of example, with reference to the accompanying drawings, in which:-

DESCRIPTION OF PREFERRED EMBODIMENT

Figure 1:
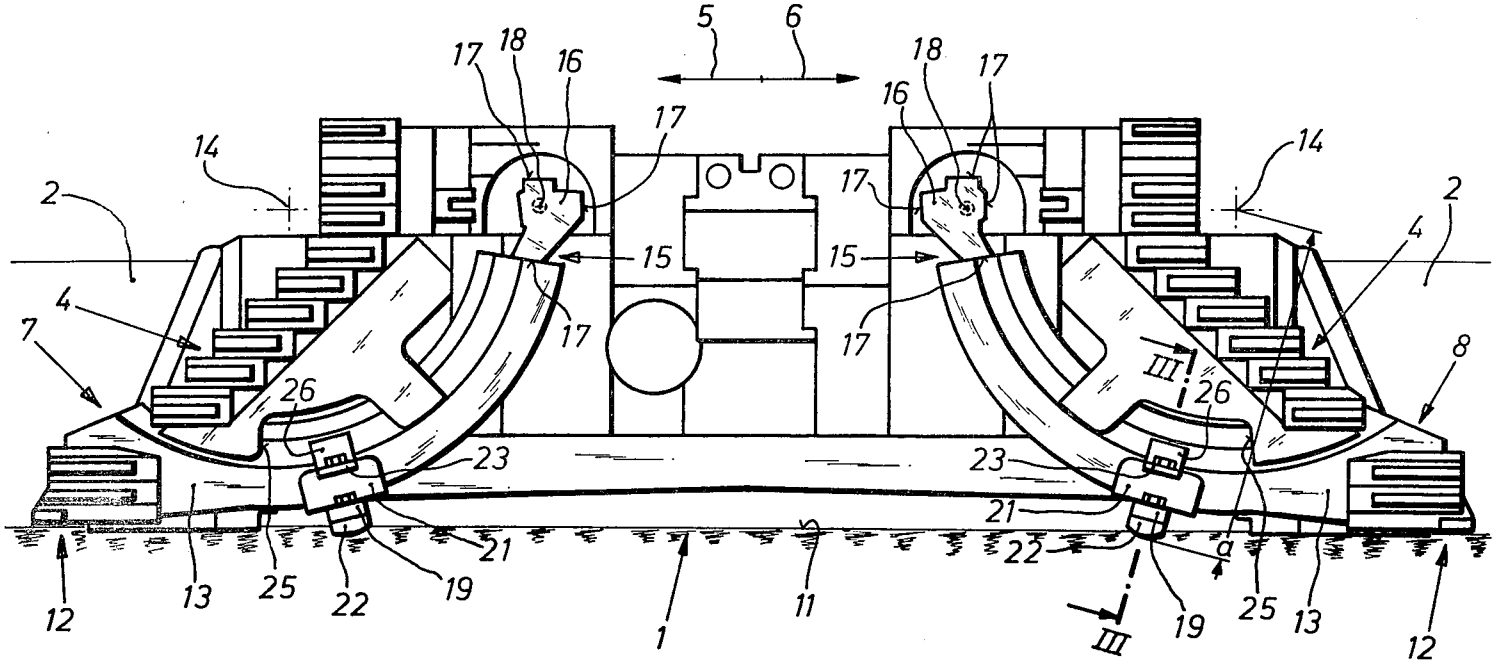
FIG. 1 is a side elevation of the coal plough as seen from the coal face being won.
Figure 2:
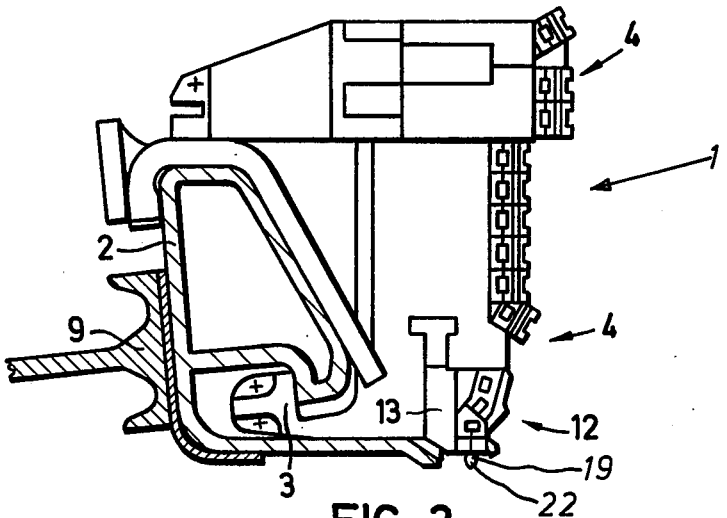
FIG. 2 is an end elevation of the coal plough of FIG. 1 looking from the left of FIG. 1.
Figure 3:
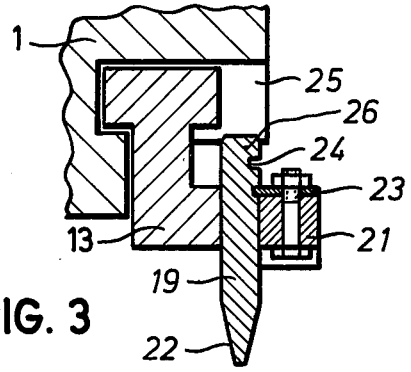
FIG. 3 is a cross-section taken on the line III—III of FIG. 1.

Referring to the drawings, FIG. 1 shows a coal plough, indicated generally by the reference numeral 1, which is movable to and fro along a guide 2 provided alongside a coal face (not shown). The plough 1 is driven by means of an endless drive chain (not shown) and a drive station (not shown). The drive chain runs in channels beneath the guide 2, and is attached to a guide block 3 which forms part of the plough 1. The plough 1 is provided with sets of cutters 4 at each end. Some of these cutters 4 are arranged in echelon formation, and some (those at the top) are positioned one above another. The set of cutters 4 at the left-hand end of the plough 1 wins coal when the plough moves in the direction of the arrow 5, and the cutters 4 at the right-hand end of the plough win coal when the plough moves in the direction of the arrow 6. The end faces 7 and 8 of the plough are inclined so as to guide won coal onto a conveyor 9 (see FIG. 2).

The plough 1 is also provided, at its base, with sets of floor cutters 12. One set of floor cutters 12 is provided at each end of the plough 1 so that coal can be won at floor level in both directions 5 and 6 of travel. Each set of floor cutters is mounted on a respective arcuate carrier 13, the two carriers 13 being symmetrically positioned on the plough 1. Each of the carriers 13 is of T-shaped cross-section and is guided in a respective arcuate guide provided on the plough 1 for pivotal movement in a vertical plane parallel to that of the coal face. The axis of the pivotal movement of each carrier 13 is indicated by the reference numeral 14. This arrangement enables the cutting level of each of the floor cutters 12 to be controlled by a respective multi-stage stop 15 constituted by a polygonal stop member 16. Each stop member 16 has a plurality of stop faces 17 each of which can be brought into engagement with the end face of the respective carrier 13 by rotating that stop member about an axis 18 which extends horizontally and perpendicularly to the coal face. FIG. 1 shows both carriers 13 in their working positions, that is to say with their cutters 12 in winning positions.

Each carrier 13 is provided with a peg 19 which projects radially therefrom towards the floor 11 of the working. Each peg 19 is clamped against its carrier 13 by means of a member 21. The radial distance a of the tip 22 of each peg 19 from the corresponding axis 14 can be set by means of a bolt 23 which is screwed into the member 21 and which engages in either one of two transverse grooves 24 machined in the side of the peg. In this way, a can be set, and locked, at either of two predetermined distances. Obviously, by providing a greater number of grooves 24, more adjustability can be achieved.

Depending upon its adjusted position, each peg 19 penetrates into the floor 11 of the working by a predetermined amount. Because of the resistance offered to the pegs 19 by the floor 11 during movement of the plough 1, the carriers 13 are subjected to a force in a direction opposite to that of plough movement. Thus, the leading floor cutters 12, for each direction 5 or 6 of travel, are pivoted into their working positions upon commencement of travel, whereas the trailing cutters 12 are pivoted out of their working positions. Upon reversal of the direction of plough travel, the new leading floor cutters 12 (formerly the trailing cutters) are pivoted into their working positions, whilst the new trailing floor cutters (formerly the leading cutters) are pivoted out of their working positions.

In order to limited the distance through which the carriers 13 are pivoted, when the floor cutters are being lifted out of their working positions, respective abutment faces 25 are provided on the plough 1, these abutment faces co-operating with stops 26 formed on the pegs 19.

The tips 22 of the pegs 19 are made of wear-resistant material. Alternatively, the entire pegs 19 could be made of wear-resistant material.

We claim:

1. In a coal plough which is movable to and fro in a mine working alongside a coal face, the plough having floor-level cutters mounted on a carrier which is pivotable in a vertical plane about a horizontal axis perpendicular to the coal face between a working position, in which it bears against a first stop, and a non-working position, in which it bears against a second stop, the cutters bearing against the floor of the working when the carrier is in the working position and being lifted clear of the floor when the carrier is in the non-working position, the first stop defining the level of cut of the cutters and the second stop limiting the upward pivotal movement of the carrier, and the first and second stops being provided on the plough, the improvement comprising cutter control means constituted by a peg which extends from the carrier towards the floor, the peg engaging the floor to move the carrier into the working position when the plough moves in one direction and to move the carrier into the non-working position when the plough moves in the opposite direction.

2. Control means according to claim 1, wherein the peg is made of wear-resistant material.

3. Control means according to claim 1, wherein the peg is provided with a floor-engaging tip made of wear-resistant material.

4. Control means according to claim 1, wherein the peg is adjustably mounted on the carrier.

5. Control means according to claim 1, wherein the peg extends radially away from the axis about which the carrier pivots.

6. Control means according to claim 5, wherein the peg is adjustably mounted on the carrier for movement in a radial direction with respect to said pivotal axis.

7. Control means according to claim 6, wherein the peg is provided with a plurality of longitudinally-spaced grooves, and the carrier is provided with a locking member which engages within a given one of said grooves to lock the peg at a predetermined radially adjusted position.

8. Control means according to claim 1, wherein the peg is provided with a stop member which co-operates with the second stop to limit the upward pivotal movement of the carrier.

9. Control means according to claim 8, wherein the stop member forms part of the peg.

10. A coal plough which is movable to and fro in a mine working alongside a coal face, the plough having two sets of floor-level cutters, one set of floor cutters being provided at one end of the plough and being operative to win coal when the plough moves in one direction, and the other set of floor-cutters being provided at the other end of the plough and being operative to win coal when the plough moves in the the other direction, each set of floor-cutters being mounted on a respective carrier which is pivotable in a vertical plane about a horizontal axis perpendicular to the coal face between a working position, in which it bears against a first stop, and a non-working position, in which it bears against a second stop, the cutters of each set bearing against the floor of the working when the carrier of that set is in the working position and being lifted clear of the floor when said carrier is in the non-working position, the first stops defining the level of cut of the cutters and the second stops limiting the upward pivotal movement of the carriers and the first and second stops being provided on the plough, wherein each carrier is provided with a peg which extends therefrom towards the floor, the peg associated with said one set of floor-level cutters engaging the floor to move the carrier of that set into the working position when the plough moves in said one direction and to move that carrier into the non-working position when the plough moves in said other direction, and the peg associated with said other set of floor-level cutters engaging the floor to move the carrier of that set into the working position when the plough moves in said other direction and to move that carrier into the non-working position when the plough moves in said one direction.

11. A coal plough according to claim 10, wherein each carrier is of arcuate formation.

* * * * *